US005725282A

United States Patent [19]

Masseth, Jr. et al.

[11] Patent Number: 5,725,282

[45] Date of Patent: Mar. 10, 1998

[54] ADJUSTABLE HANDLES FOR ROAD SURFACE CUTTING SAWS

[75] Inventors: James E. Masseth, Jr., Henrietta; James R. Rau, Rochester; David W. Lodge, Cananadaiqua, all of N.Y.

[73] Assignee: Stone Construction Equipment, Inc., Honeoye, N.Y.

[21] Appl. No.: 700,086

[22] Filed: Aug. 20, 1996

[51] Int. Cl.[6] ..... E01C 23/09; B25B 01/22

[52] U.S. Cl. ..... 299/39.3; 280/47.315; 403/97

[58] Field of Search ..... 299/39.3; 404/90; 125/13.02, 13.03, 14; 280/655, 655.1, 47.315, 47.371; 403/97, 110

[56] References Cited

U.S. PATENT DOCUMENTS

| | | | |
|---|---|---|---|
| 2,468,336 | 4/1949 | Lewis | 299/39.3 |
| 2,889,141 | 6/1959 | Wilson | 299/39.3 |
| 2,938,734 | 5/1960 | Guimond | 280/47.315 |
| 2,973,950 | 3/1961 | Tucker | 299/39.3 |
| 3,513,924 | 5/1970 | Jackson | 180/14.1 |
| 3,995,650 | 12/1976 | DiVito | 135/72 |
| 4,023,436 | 5/1977 | Dodge | 74/551.3 |
| 4,253,649 | 3/1981 | Hewson | 269/45 |
| 4,840,431 | 6/1989 | Jedick | 299/39.3 |
| 5,039,118 | 8/1991 | Huang | 280/47.371 |

*Primary Examiner*—David J. Bagnell

*Attorney, Agent, or Firm*—Jacobson, Price, Holman & Stern, PLLC

[57] ABSTRACT

Adjustable handles for road surface cutting saws are disclosed. The handles are elongated tubular members projecting rearwardly from opposite side edge sections of a generally vertically disposed housing. The handles are independently adjustable, forwardly and rearwardly in the longitudinal direction and angularly about a transverse horizontal axis, to position hand grips on the handles in optimum position for operator control of the saw, operator access to the saw controls and storage of the handles in a forwardmost position to enable the saw to be stored in a compact condition. A pair of substantially identical clamp assemblies including inner and outer clamp elements are mounted on the inside of the side walls adjacent the rear of the housing and clampingly hold the handles in the selected longitudinal and angular positions. A bolt extending substantially transversely through the inner and outer clamp element of each clamp assembly and the side wall cooperates with a knob on the outside of the side wall to tighten or loosen the clamp elements.

13 Claims, 2 Drawing Sheets

ADJUSTABLE HANDLES FOR ROAD SURFACE CUTTING SAWS

BACKGROUND OF THE INVENTION

1. Field of the Invention

The present invention generally relates to adjustable handles for road surface cutting saws and more particularly to independently adjustable handles projecting rearwardly from opposite side edge portions of a generally vertically disposed housing.

2. Description of the Prior Art

It is well known to provide various apparatuses and equipment with an adjustable handle or handles for manual control of the apparatus or equipment. Various types of wheeled devices are provided with a pair of adjustable handles to enable an operator or user to maintain directional control and operational control of the device.

Various examples of equipment with adjustable handles, including road surface cutting saws, are shown in the following U.S. patents:

| | | |
|---|---|---|
| 2,468,336 | 3,995,650 | 4,840,431 |
| 2,889,141 | 4,023,436 | 5,039,118 |
| 3,513,924 | 4,253,649 | |

While these patents disclose various types of adjustment structures and various handle arrangements for machines or wheeled vehicles, they do not disclose a structure having the arrangement, flexibility and adjustability of the handles for road surface cutting saws incorporated into this invention.

SUMMARY OF THE INVENTION

In accordance with the present invention, independently adjustable handles are provided for a mobile road surface cutting saw. The handles are in the form of elongated tubular members with hand grips on their rearward ends and the other end extends into the saw housing. The handles are longitudinally adjustable forwardly and rearwardly and angularly adjustable about transverse horizontal axis. Such adjustability allows the operator to position the hand grips on the handles in optimum position for operator control of the saw and operator access to all of the saw controls. It further permits storage of the handles in a forwardmost position to enable the saw to be stored in a compact condition. The portion of the handle tubular member extending into the housing is received between a pair of clamp elements. The clamp elements have a clamp bolt extending therethrough that includes a threaded portion extending externally of the housing and is provided with a clamp knob thereon. The housing and the clamp elements include serrations radiating from the bolt to enable angular adjustment as well as longitudinal adjustment through the clamp elements with the manual knob locking the handle in both longitudinally and angularly adjusted positions.

It is therefore an object of the present invention to provide adjustable handles for a road surface cutting saw in which a pair of independently adjustable handles are mounted in laterally spaced relation on a housing with each handle being independently adjustable longitudinally in a forward and rearward relationship to the housing and angularly about a transverse axis at the rear section of the housing.

Another object of the present invention is to provide adjustable handles in accordance with the preceding object in which each handle is an elongated straight tubular member preferably constructed of metal provided with a padded hand grip at the terminal rear end thereof for enabling an operator to manually grip and control the handles and thus manually control movement of the saw and gain access to the controls normally mounted on the housing.

A further object of the invention is to provide adjustable handles for a road surface cutting saw in which each handle is supported for longitudinal adjustment and can be locked in any longitudinally adjusted position by a manually operated clamp assembly mounted on the housing.

Still another object of the invention is to provide adjustable handles for a road surface cutting saw in which each of the elongated tubular handles is supported for angular adjustment about a transverse axis with a manual clamp assembly securing the handles in angularly adjusted position thereby enabling the hand grips to be positioned in optimum orientation with respect to the housing, ground surface and operator's hands.

A final object of the invention to be recited herein is to provide adjustable handles in accordance with the preceding objects in which the clamp assembly for securing the handles in longitudinally adjusted position and the clamp assembly for securing the handles in angularly adjusted position are incorporated into a structure which enables a single manually rotated knob threaded onto a clamp bolt to effectively secure each handle in an optimum adjusted position.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENT

Figure 1:
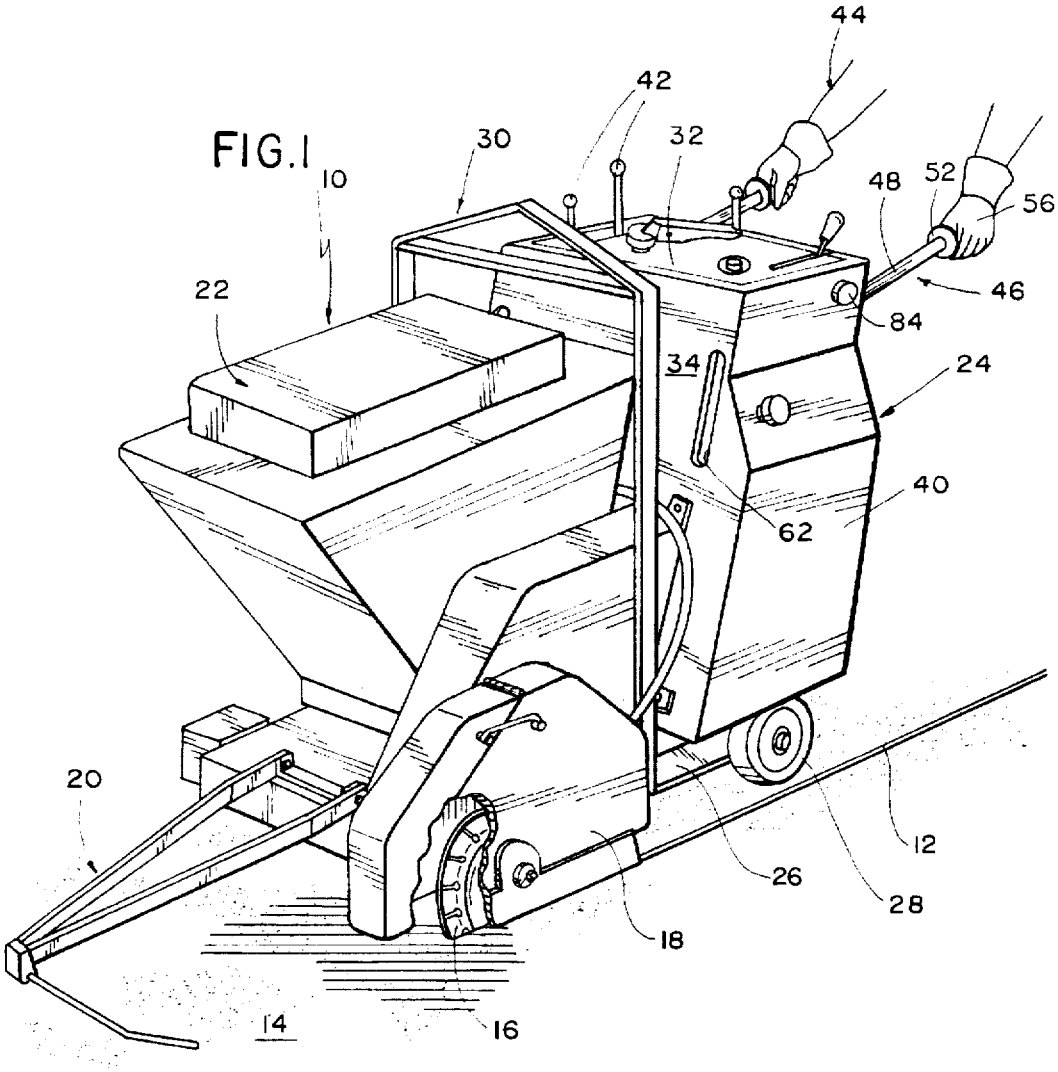
FIG. 1 is a perspective view of adjustable handles mounted on a road surface cutting saw in accordance with this invention and illustrating the orientation of the handles in relation to the housing and controls for the saw.

In describing the preferred embodiment of the present invention as illustrated in the drawings, specific terminology will be resorted to for the sake of clarity. However, the invention is not intended to be limited to the specific embodiment illustrated and terms so selected; it being understood that each specific term includes all technical equivalents which operate in a similar manner to accomplish a similar purpose.

Referring to FIG. 1 of the drawings, a road surface cutting saw is generally designated by reference numeral 10. The cutting saw 10 is typically used to form a groove or slot 12 in a road surface 14 such as concrete, asphalt or other road pavement surfaces. The road surface cutting saw 10 includes a power driven rotary circular saw blade 16 enclosed by a guard structure 18 and exposed along the bottom of the guard to cut the groove or slot. A guide structure generally designated by 20 is located forwardly of the saw blade 16 and located above the saw blade is an engine assembly 22 of conventional construction which drives the saw blade in a well known manner. Rearwardly of the engine compartment 22 is a housing 24 mounted on a frame 26 supported by wheels 28.

Centrally located on the apparatus is a lifting frame generally designated by reference numeral 30 by which the apparatus can be lifted by a lift device in order to place it on a transport vehicle or place it on a road surface from a load transport vehicle. This general arrangement of components is well known in the design and construction of road surface cutting saws.

Figure 2:
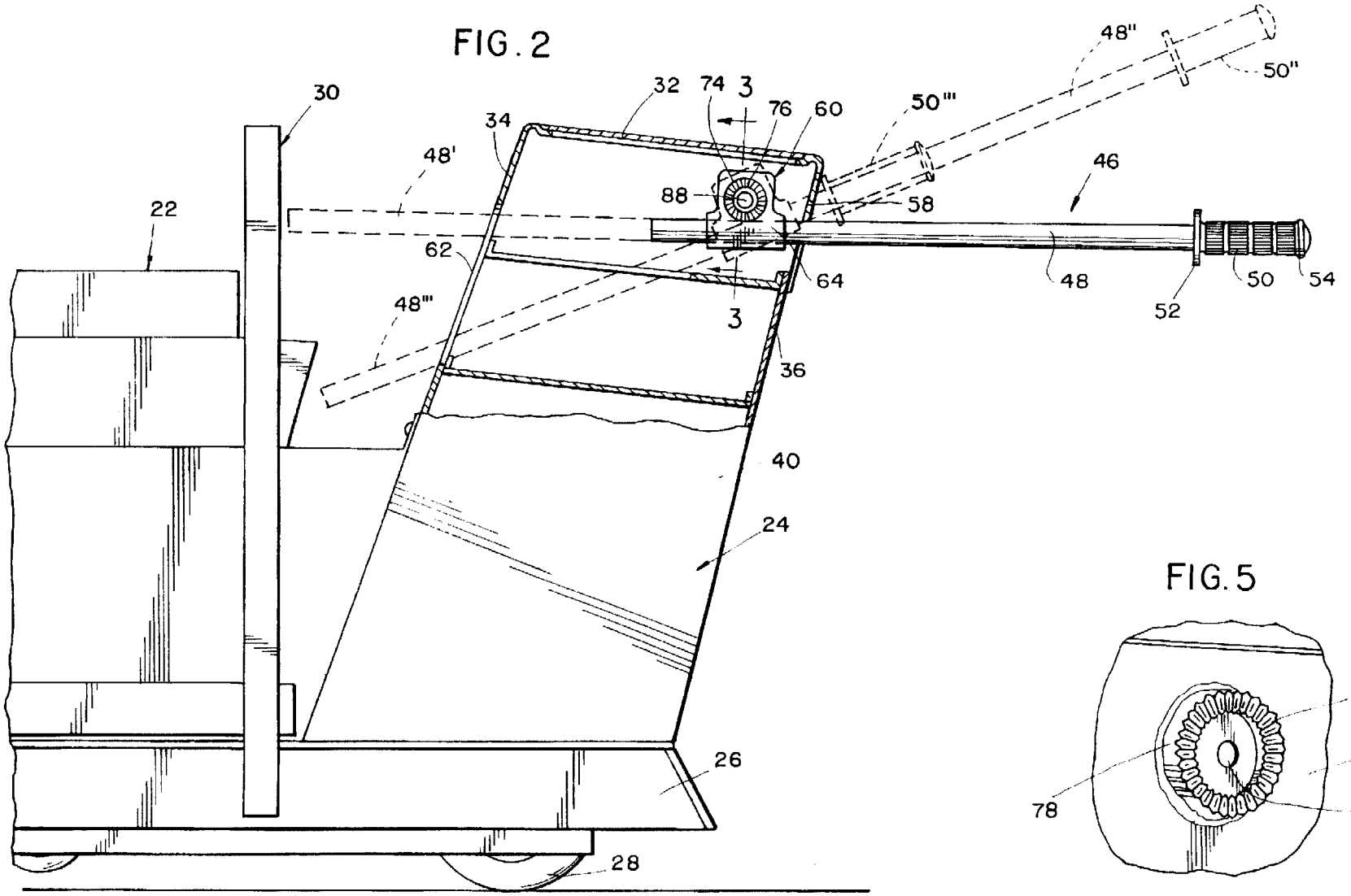
FIG. 2 is a vertical sectional view of the housing illustrating adjustable positions of the handles and the orientation of the mounting clamp assembly that adjustably supports and locks the handles longitudinally and angularly in accordance with the present invention.
Figure 5:
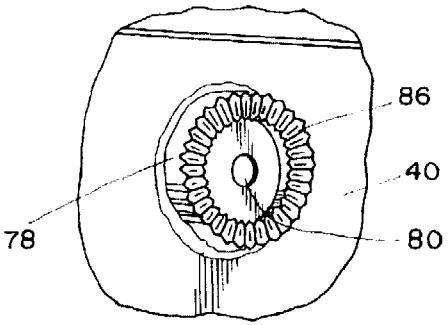
FIG. 5 is a perspective view illustrating the serrated disk mounted on the interior surface of the housing side panel to secure the clamp assembly and handle in angularly adjusted position in accordance with the present invention.

As illustrated in FIGS. 1 and 2, the housing 24 includes a top panel 32, a front panel 34, a rear panel 36 and opposite side panels 40. The top panel 32 includes various machine control mechanisms 42 located on or projecting above the top panel for ready access by an operator 44 of the apparatus. The control mechanisms include control of the operation of the internal combustion engine which powers the saw, control of the speed of the saw and its vertical elevation to determine the depth of cut of the groove or slot, control the forward speed of the apparatus and other operational controls all of which must be readily accessible to the operator so that the operator can maintain effective control and operation of the road surface cutting saw.

In order to enable the operator 44 to effectively maintain control of the apparatus during its use, a pair of laterally spaced, generally parallel handles 46 are provided which extend rearwardly from an upper portion of the housing 24 at each side thereof as illustrated in FIGS. 1 and 2. Each handle 46 includes a straight, elongated tubular member 48, preferably of metal, having a padded hand grip 50 on the rearward end thereof with a forward flange 52 and a rearward knob 54 to enable effective gripping by the hand 56 of the operator 44. The forward end of the tubular member 48 extends through a vertically elongated slot 58 located in the upper portion of rear panel 36 as illustrated in FIG. 2. The tubular member 48 is adjustably secured longitudinally and angularly by a mounting clamp assembly generally designated by reference numeral 60 which enables the tubular member to be adjusted longitudinally forwardly and rearwardly as illustrated by the horizontal broken line position indicated by reference numeral 48' in FIG. 2.

The mounting clamp assembly 60 also enables the tubular member 48 to be pivoted about a transverse axis as indicated by reference numeral 48" in FIG. 2 with the tubular member 48 also being longitudinally adjustable when in the position indicated by broken line 48" so that it can be moved forwardly and rearwardly while in an angular position with the forwardmost position of the forward end of the tubular member being designated by numeral 48''' in FIG. 2. As illustrated in FIGS. 1 and 2, the forward panel 34 of the housing 24 includes a vertically elongated slot 62 which enables adjustment of the tubular member 48 forwardly and rearwardly when in a horizontal position and forwardly and rearwardly when in an upwardly and rearwardly inclined position as illustrated in FIG. 2.

Figure 3:
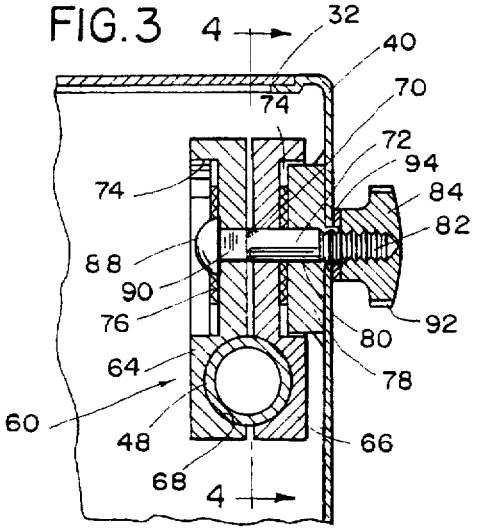
FIG. 3 is a vertical sectional view, on an enlarged scale taken along section line 3—3 on FIG. 2, illustrating further structural details of the clamp assembly for securing one handle in an adjusted position.
Figure 4:
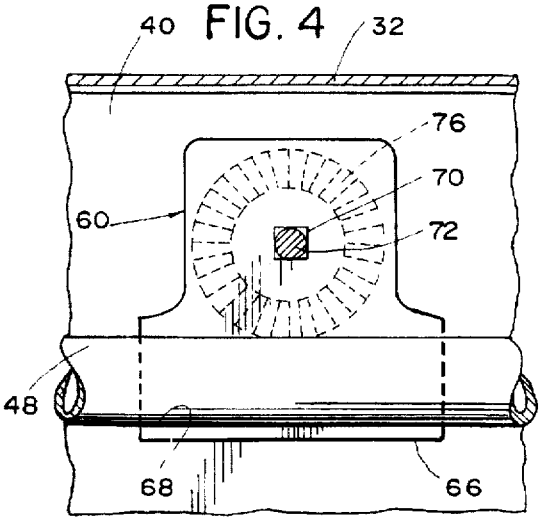
FIG. 4 is a vertical sectional view taken along section line 4—4 on FIG. 3, illustrating further structural details of the clamp assembly for securing one handle in an adjusted position.

The mounting clamp assembly 60 for each of the handles 46 includes an inner clamp element 64 and an outer clamp element 66 oriented in facing opposed relation as illustrated in FIG. 3. The inner surfaces of clamp elements 64 and 66 are each provided with a partial cylindrical surface or groove 68 in the lower portion thereof which conforms with the external circumference of the tubular member 48 and receives a substantial portion of the external surface of the tubular member 48. However, the recess or groove 68 does not extend for a full 180° thus spacing the internal surfaces of the clamp elements 64 and 66 and enabling them to securely grip and lock the tubular member 48 in longitudinally adjusted position.

Each of the clamp elements 64 and 66 includes a transverse aperture or bore 70 spaced above the recesses 68 for receiving a clamp bolt 72 extending therethrough. The outer surface of each clamp element 64 and 66 is provided with a cylindrical recess 74. The inner wall of each recess 74 includes a plurality of radial serrations 76 in the form of alternating ridges and grooves extending from the circumference of the cylindrical recess 74 inwardly to a point spaced radially from the aperture 70. Rigidly mounted, as by welding or the like, on the inner surface of the side panel 40 is a stationary cylindrical disk 78 which has an aperture or bore 80 extending therethrough to receive the bolt 72 as illustrated in FIG. 3. The stationary disk 78 has an outer circumference which is slightly larger than the cylindrical surface defined by the circumference of recess 74 so that when assembled the disk 78 is closely received within one of the recesses 74 to define a pivot axis transversely of the housing 24, concentric with the bores or apertures 70 and 80 and concentric with the center of the bolt 72. Also, the outer surface of disk 78 has a plurality of radial serrations 86 substantially the same as serrations 76 which can mate and lock with the serrations 76 on the facing recess 74.

As illustrated in FIG. 3, the bolt 72 has a threaded outer end 82 that is threaded into an internally threaded hand knob 84 in order to move the clamp elements 64 and 66 into positions to clamp or unclamp the tubular member 48 forming the handle 46 and lockingly engage the serrations 76 in the recess 74 in the inner clamp element 66 with the corresponding serrations 86 on the surface of the stationary disk 78 which faces the clamp element 66. The bolt 72 is a conventional carriage bolt with a rounded head 88 and a partially square shank 90 received in a square opening in the outer clamp element 64 to prevent rotation of the bolt when loosening and tightening the knob 84. The knob 84 is provided with serrations or ribs and grooves 92 on its periphery to enable effective gripping engagement of the knob 84 when tightening or loosening the mounting clamp assembly 60. Also, the knob 84 is preferably provided with a friction washer or disk 94 between the inner end thereof and the outer surface of the side panel 40 to lock the knob in adjusted position and prevent loosening thereof due to vibration of the apparatus.

When the handles 46 are moved forwardly to their extreme forward position in which the tubular member 48 is fully inserted through the clamp elements, the road surface cutting saw can be stored in a much smaller area since the rearward projection of the handles 46 then is only approximately the length of the hand grips 50 thereby forming only a short projection from the rear panel 36 of the housing 24. The multiple angular position of the handles 46 provides adjustment of the hand grips 50 to any height or angle to conform to any size operator thereby providing more effective steering control of the apparatus by the operator using either hand force or hip force with less effort required. When the handles 46 are fully extended rearwardly, the operator 44 can easily grip the hand grips and in some instances can move forwardly so that the hand grips straddle the hips of the operator to enable hip control of the apparatus. Also, when the handles 46 are fully extended rearwardly, the operator is provided with more leverage due to the length of the tubular members 48 extending rearwardly from the housing thereby enabling the operator to more effectively control the apparatus and at the same time enable the operator to reach the controls 42 on the top panel 32 of the housing.

This adjustable handle structure enables operators having a wide range of height, strength and reach to more effectively control the apparatus and enables more effective control under a variety of cutting operations such as when cutting uphill or downhill. Additionally, the multiple adjustment characteristics of the handles enable more effective control by the operator through a range of different cutting depths. For example, when using one diameter blade, such as a 20 inch blade in making a 1 inch deep groove and then using the same blade to make a maximum 7½ inch groove, handle adjustment provides for substantially constant attitude of the handles in relation to the operator. Further, the preferred construction of each of the clamp elements 64 and 66 with a cylindrical recess 74 and serrations 76 extending inwardly from the periphery of the recess to a position spaced from the periphery of the hole 70 enables identical clamp elements 64 and 66 to be utilized even though the serrations 76 on the inner clamp element 64 do not perform a function when used on the side shown in FIG. 3 but would engage disk 78 welded or attached on the other inner side 40 of housing 24. Hence this preferred structure enables the two clamp elements 64 and 66 to be identical in construction and thus interchangeable for ease of manufacture and inventory. The number and depth of the serrations 76 and 86 may vary, it only being necessary that the serrations 86 on the stationary pivot disk 78 be the same as the serrations 76 on the clamp elements for effective locking engagement of the clamp elements in relation to the stationary pivot disk. The degree of variation in the angular positions is determined by the number of teeth forming the serrations.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. Handles for a road surface cutting saw having a powered rotatable saw blade to form a vertical cut in a road surface and including a generally vertically disposed support surface at a rearward end portion thereof, said handles comprising a pair of laterally spaced elongated handles, a mounting clamp assembly on said support for each of said elongated handles, said mounting clamp assemblies being laterally spaced and independent of each other, each mounting clamp assembly including a pair of clamp elements clampingly engaging the elongated handle to enable longitudinal adjustment of the elongated handle forwardly and rearwardly of the support when unclamped and securely clamping the elongated handle in longitudinally adjusted position, each of said clamp assemblies also including a clamping bolt connected with the support and defining a pivot axis for the clamping elements and elongated handle with the pivot axis being substantially transverse of the support to enable the handle members to be adjusted in a generally vertical plane about a substantially transverse axis, said pivot bolt defining the axis of pivotal movement of the elongated handles and clamping and unclamping the clamp elements.

2. The handles as defined in claim 1 wherein said support is a housing including side panels, each mounting clamp assembly including a stationary pivot disk rigidly supported on the inner surface of the side panel and including a central aperture through which the clamp bolt extends, each of said clamp bolts including a threaded end located externally of the side panel and provided with a threaded member thereon, said clamp bolt having an inner end engaging an inner clamp element with the clamp bolt extending through an outer clamp element and moving the clamp elements toward the pivot disk when the threaded member is tightened onto the clamp bolt thereby simultaneously locking the elongated handle in longitudinally adjusted position and angularly adjusted position.

3. The handles as defined in claim 2 wherein said elongated handle is a straight tubular member of rigid construction and of circular cross-section, each of said clamp elements including a partial cylindrical recess engaging a portion of the periphery of said tubular member to enable longitudinal adjustment of the tubular member and locking engagement with the tubular member when the clamp bolt is tightened.

4. The handles as defined in claim 3 wherein said pivot disk and outer clamp element have interengaging radial serrations concentric with the clamp bolt for engagement when the clamp bolt is tightened to lock the clamp elements and tubular member extending therethrough in angular position about the clamp bolt when the threaded member on the clamp bolt is tightened.

5. The handles as defined in claim 4 wherein said bolt is a carriage bolt locked against rotation in relation to the clamp elements and said threaded member is a knob to enable manual tightening and loosening of the clamp bolt.

6. The handles as defined in claim 5 wherein said housing includes forward and rearward panels connected to the side panels, each of said forward and rearward panels including a vertically elongated slot receiving said elongated tubular members to enable longitudinal and angular adjustment of the handles, the rearward ends of the handles having a hand grip thereon with longitudinal adjustment of the elongated tubular members enabling the hand grips on the handles to be oriented adjacent the rear panel to enable storage of the road surface cutting saw in a compact condition.

7. The handles as defined in claim 6 wherein said housing includes a top panel with saw control mechanisms associated therewith, said longitudinal and angular adjustment of the handles enabling an operator of different sizes to position the handles for optimum manipulative control of the handles and optimum reach capability to the control mechanisms on the top panel regardless of the size of the operator and also enabling optimum position of the handles when the road surface cutting saw is forming different depth grooves in a road surface with a constant diameter saw and when forming grooves in an uphill and downhill direction.

8. The handles as defined in claim 4 wherein said pivot disk is cylindrical, said outer clamp element facing the pivot disk including a cylindrical recess telescopically receiving the cylindrical pivot disk to define a pivot axis coincidental to the center of the pivot bolt, the serrations on the pivot disk being on the axial surface thereof and the serrations on the clamp element telescoped over the pivot disk being on the axial inner surface of the recess.

9. A road surface cutting saw having a powered rotatable saw blade to form a vertical cut in a road surface and a generally vertically disposed housing at a rearward end section thereof, a pair of laterally spaced elongated handles mounted on said housing, a pair of clamp assemblies mounted on said housing and clampingly engaging each elongated handle to enable longitudinal adjustment of the elongated handles forwardly and rearwardly of the housing when unclamped and securely clamping the elongated handles in longitudinally adjusted position, a clamping bolt extending through each clamp assembly and connected with the housing to define a pivot axis for each clamp assembly and elongated handle, said pivot axis being substantially transverse of the housing to enable the elongated handles to be adjusted in a generally vertical plane about a substantially transverse axis, said pivot bolt defining the axis of pivotal movement of the elongated handles and clamping and unclamping each clamp assembly.

10. The road surface cutting saw as defined in claim 9 wherein said housing includes side panels, a stationary pivot disk rigidly supported on an inner surface of each side panel and including a central aperture through which the clamp bolt extends, each of said clamp bolts including a threaded end located externally of the side panel and provided with an internally threaded knob thereon, each clamp assembly including an inner clamp element and an outer clamp element, said clamp bolt having an inner end engaging said inner clamp element with the clamp bolt extending through said outer clamp element and moving the clamp elements toward the pivot disk when the threaded knob is tightened onto the clamp bolt thereby simultaneously locking the elongated handle in longitudinally adjusted position and angularly adjusted position.

11. The road surface cutting saw as defined in claim 10 wherein each elongated handle is a straight tubular member of rigid construction and of circular cross-section, each of said clamp elements including a partial cylindrical recess engaging a portion of the periphery of said tubular member to enable longitudinal adjustment of the tubular member and locking engagement with the tubular member when the clamp bolt is tightened, each pivot disk and outer clamp element having interengaging radial serrations concentric with the clamp bolt for engagement when the clamp bolt is tightened to lock the clamp elements and tubular member extending therethrough in angular position about the axis defined by the clamp bolt when the threaded knob on the clamp bolt is tightened.

12. The road surface cutting saw as defined in claim 11 wherein said housing includes forward and rearward panels connected to the side panels, each of said forward and rearward panels including a vertically elongated slot receiving said elongated tubular members to enable longitudinal and angular adjustment of the handles, the rearward ends of the handles having a hand grip thereon with longitudinal adjustment of the elongated tubular members enabling the hand grips on the handles to be oriented adjacent the rear panel to enable storage of the road surface cutting saw in a compact condition.

13. The road surface cutting saw as defined in claim 11 wherein said housing includes a top panel with saw control mechanisms associated therewith, said longitudinal and angular adjustment of the handles enabling an operator of different sizes to position the handles for optimum manipulative control of the handles and optimum reach capability to the control mechanisms on the top panel regardless of the size of the operator and also enabling optimum position of the handles when the road surface cutting saw is forming different depth grooves in a road surface with a constant diameter saw and when forming grooves in an uphill and downhill direction.

* * * * *